US008528990B2

(12) United States Patent
Latham

(10) Patent No.: US 8,528,990 B2
(45) Date of Patent: Sep. 10, 2013

(54) CUTTER WITH DIAMOND BIT TIP

(75) Inventor: Winchester E. Latham, Avon, IN (US)

(73) Assignee: Keystone Engineering & Manufacturing Corporation, Avon, IN (US)

( * ) Notice: Subject to any disclaimer, the term of this patent is extended or adjusted under 35 U.S.C. 154(b) by 0 days.

(21) Appl. No.: 13/324,148

(22) Filed: Dec. 13, 2011

(65) Prior Publication Data

US 2012/0080930 A1 Apr. 5, 2012

Related U.S. Application Data

(63) Continuation-in-part of application No. 12/357,916, filed on Jan. 22, 2009, now abandoned.

(51) Int. Cl.
*E21C 35/197* (2006.01)

(52) U.S. Cl.
USPC ..... 299/103

(58) Field of Classification Search
USPC ..... 299/79.1, 85.2, 100–111, 112 R, 299/112 T, 113
See application file for complete search history.

(56) References Cited

U.S. PATENT DOCUMENTS

| | | | | |
|---|---|---|---|---|
| 2,121,044 A | | 6/1938 | Noble | |
| 3,318,401 A | | 5/1967 | Carbert | |
| 4,302,053 A | * | 11/1981 | Roepke et al. | 299/110 |
| 4,316,636 A | | 2/1982 | Taylor et al. | |
| 4,333,687 A | | 6/1982 | Barnstorf | 299/81 |
| 4,337,980 A | | 7/1982 | Krekeler | 299/91 |
| 4,480,873 A | | 11/1984 | Latham | 299/87 |
| 4,697,850 A | | 10/1987 | Tuneblom | 299/87 |
| 4,871,213 A | | 10/1989 | Hanson | 299/64 |
| 5,007,685 A | | 4/1991 | Beach et al. | |
| 5,016,943 A | | 5/1991 | Wirtgen | 299/87 |
| 5,052,757 A | | 10/1991 | Latham | 299/87 |
| 5,078,540 A | | 1/1992 | Jakob et al. | 404/90 |
| 5,098,167 A | | 3/1992 | Latham | 299/86 |
| 5,261,499 A | | 11/1993 | Grubb | |
| 5,318,351 A | | 6/1994 | Walker | 299/86 |

(Continued)

FOREIGN PATENT DOCUMENTS

| | | |
|---|---|---|
| DE | 2854307 A | 7/1980 |
| EP | 2210725 A1 | 7/2010 |
| JP | 2000-120644 | 4/2000 |

OTHER PUBLICATIONS

Extended European Search Report issued May 19, 2010, in European Patent Application No. 10151055.0 (8 pgs).

*Primary Examiner* — Sunil Singh
(74) *Attorney, Agent, or Firm* — Brinks Hofer Gilson & Lione

(57) ABSTRACT

An apparatus for use on a portion of a milling or mining drum may include a base portion and a cutter bit. The cutter bit may include a tip region, a flange having a nut-like gripping surface, and a shank portion. At least a distal end of the shank portion may include a threaded portion. The shank portion may be received in an opening of the base portion. The opening of the base portion may be internally threaded to engage the threaded portion of the shank portion of the cutter bit. The base portion may include a lower region having a second threaded portion of smaller diameter than the threaded portion engaging the shank portion of the cutter bit. A retainer may be internally threaded into the opening of the base portion and threadably engaged in the second threaded portion.

3 Claims, 9 Drawing Sheets

(56) References Cited

U.S. PATENT DOCUMENTS

| | | | | |
|---|---|---|---|---|
| 5,582,468 | A | 12/1996 | Latham | 299/106 |
| 5,833,017 | A | 11/1998 | Woods et al. | |
| 5,842,747 | A | 12/1998 | Winchester | 299/87.1 |
| 5,884,979 | A | 3/1999 | Latham | 299/106 |
| 6,024,635 | A | 2/2000 | Cruickshank et al. | 451/541 |
| 6,051,079 | A | 4/2000 | Andersson et al. | 148/318 |
| 6,086,160 | A | 7/2000 | Bitelli | 299/104 |
| 6,331,035 | B1 | 12/2001 | Montgomery, Jr. | 299/106 |
| 6,364,420 | B1 | 4/2002 | Sollami | 299/106 |
| 6,390,352 | B1 | 5/2002 | Sollami | |
| 6,692,083 | B2 | 2/2004 | Latham | 299/104 |
| 6,764,140 | B2 | 7/2004 | Carson, Jr. et al. | 299/79.1 |
| 6,779,850 | B1 | 8/2004 | Schibeci et al. | 299/87.1 |
| 6,832,818 | B2 | 12/2004 | Luciano | 299/39.8 |
| 6,863,352 | B2 | 3/2005 | Sollami | 299/107 |
| 7,108,212 | B2 | 9/2006 | Latham | 241/294 |
| 7,168,501 | B2 | 1/2007 | Willibald | 172/123 |
| 7,290,726 | B2 | 11/2007 | Latham | 241/294 |
| 7,338,134 | B2 | 3/2008 | Latham | 299/87.1 |
| 7,380,887 | B2 | 6/2008 | Latham | 299/87.1 |
| 7,537,288 | B2 * | 5/2009 | Chiang | 299/102 |
| 7,740,414 | B2 | 6/2010 | Hall et al. | 404/82 |
| 7,832,808 | B2 | 11/2010 | Hall et al. | 299/104 |
| 8,424,974 | B2 | 4/2013 | Latham | |
| 2003/0209366 | A1 | 11/2003 | McAlvain | 175/427 |

* cited by examiner 210
226
238
246
252
250
248
237
244
242
240
230
232
224
236
233
234
212
220
228
216
222
218
214
Z 220
228
230
216
218
214
212

CUTTER WITH DIAMOND BIT TIP

CROSS-REFERENCE TO RELATED APPLICATIONS

This application is a continuation-in-part of application Ser. No. 12/357,916 filed Jan. 22, 2009, now abandoned.

FIELD OF THE INVENTION

This invention generally relates to the field of rotary driven cylindrical cutter devices and scarifiers for use in roadway surface reclaiming, earthworking, milling, mining, or other in situ disintegration of hard materials. More particularly, the present invention is directed to cutter bit inserts for such rotary driven cylindrical cutter devices and scarifiers.

BACKGROUND OF THE INVENTION

In general, roadway surface milling, planing, or reclaiming equipment disclosed in the prior art includes a rotary driven cylindrical comminuting drum which acts to scarify and to mine the top portion of the asphaltic road surface in situ. Another application using a rotary driven cylindrical comminuting drum is coal mining. Coal mining machines with shearing drums are used rather widely in mining, particularly in underground mining of bituminous coal. Regardless of the application, the rotary driven drum may include flighting on the drum which acts to collect the mined or milled material or rubble toward the center of the drum where the material can be removed. In roadway surface milling, the rubble is then remixed with additional bituminous material and thereafter redeposited as a newly formed smooth asphaltic surface. In coal mining, the loosened coal rubble is collected onto a pan line, taking the coal to the conveyor belt for removal from the work area to the surface where the rubble is further processed.

In some prior art devices of this type, a plurality of cutter bit support members are connected to the curved surface of the drum or to the flighting by bolts or by weld. The plurality of the support members may be arranged end-to-end so as to form a substantially continuous helical pattern. The top surface of the helically arranged support members may be elevated above the curved surface of the drum. The top surfaces include angled openings into which conventional cutter bits are received. The cutter bits are generally a conical cutter with preferably a tungsten carbide tip or the like. Optionally, the support member may include an opening for receiving cutter bit insert that is removably mounted to the support member, for instance by threaded attachment. The insert has an opening for receiving the cutter bit and a gripping surface used for inserting and removing the cutter bit inserts with respect to the support members.

One example of a cutter bit insert is disclosed in U.S. Pat. No. 5,842,747 to Latham. Here, the insert includes a gripping surface, a conical shoulder, and a lower surface, defines an interior bore for receiving a cutter bit, and has external threads capable of threaded engagement with threads of a base portion. The gripping surface allows for easy access for removal of inserts. Threaded jamming fastener is also disposed in threaded engagement with threads of the base portion. The jamming fastener is initially positioned below the insert by use of an appropriate tool in the jamming fastener opening. After the insert is in place, the appropriate tool again is inserted in the jamming fastener opening and rotated to translate the jamming fastener toward the lower end of the insert until contact. Accordingly, the reverse is true when removing such insert from the base portion, especially when the insert is damaged.

Damage to the cutter bit inserts can be common. During use, abrasive forces, which often include rather substantial extreme sudden shocks, are transmitted to the cutter bits. Oftentimes, the forces are unevenly distributed between the cutter bits and inserts, which cause the cutter bits to vibrate and otherwise move and rotate within the support member opening or within the insert. Particularly in the presence of abrasive dust from the roadway surface reclaiming operation and the mining operation, the vibration and movement of the cutter bits act to enlarge the openings to such an extent that the cutter bits can be thrown out of the inserts. Indeed, depending on the abrasiveness of the mining surface, cutter bits can become damaged after about 4 hours to about 1 week of operation. It is desirable for the less expensive cutter bit to become damaged before the more expensive insert and even the more expensive and difficult to replace support member, in order to extend the life of the insert and the support member.

Unfortunately, in the event of damage to the insert or the support member, the mining machine must be stopped for a considerable length of time for repair. Repair and replacement of the insert damaged in this manner typically necessitates the use of an easy-out or similar removing tool in the field to remove the insert. Typically as a last resort, it becomes necessary to remove the support member portions, usually with the aid of a cutting torch, and to weld new support member portions in place. This is a time-consuming repair job which results in considerable expense to a mining machine operation, and results in a decreased rate in mining.

Despite the availability of such devices, there exists a need in the art for an apparatus having a cutter bit insert for a mining drum that is capable of removable attachment to a support member, yet is resistant to loosening upon rotation of the mining drum. There is also a need for an insert to wear before the support member in order to decrease the time and costs of repair and replacement. In particular, it becomes necessary to have a wear insert that is a sacrificial or expendable component relative to the more expensive support member.

SUMMARY

The present invention provides an apparatus for use on a portion of a mining drum that is adapted to be rotated in a cutting direction about a cylindrical axis defined by the mining drum. More specifically, in one embodiment the apparatus can include a base portion adapted to be mounted to the mining drum. The base portion can define an opening to receive a wear insert for retaining a cutter bit. The opening of the base portion can have a first seat, which may be conical, at an upper end and/or a lower end. The wear insert is engageable within the base portion opening and can include a gripping surface, flange, and a threaded portion. The gripping surface is preferably proximate the upper end of the base portion, while the flange, which may be conical, extends from the gripping surface to a middle portion. The threaded portion may extend from the middle portion to proximate the lower end of the base portion. The wear insert flange can frictionally engage with the first seat of the base portion opening. The wear insert can also define an interior bore for receiving at least one cutter bit at a fixed position relative to the wear insert. The interior bore can include a first portion having a cross-sectional area and a second portion having a cross-sectional area less than the cross-sectional area of the first portion to define a flange within the interior bore. In one example, the interior bore includes a step ring attached to the surface of the interior bore. The step ring can have an outer edge with a cross-sectional area substantially similar to the cross-sectional area of the interior bore and an inner edge with a cross-sectional area that is less than the cross-sectional area of the outer edge. The inner edge may have a lower portion that includes a chamfered edge.

The apparatus can further include a retainer having a threaded portion to threadably engage with the threaded portion of the wear insert. The conical shape of the flanges and seats of the wear insert and retainers can be substantially similar, being tapered at an angle in the range between about 10 degrees to about 70 degrees. The retainer is positioned and configured to engage the threaded portion and the side of the base portion facing away from the milled surface of the mining drum in order to reduce the amount of dust from entering the threads. Some embodiments include an expandable cylindrical sleeve disposed within the interior bore of the wear insert to frictionally engage with the cutter bit within the interior bore that can prevent the cutter bit from translating within the wear insert. The interior bore of the wear insert may include a protrusion to engage with a portion of the expandable sleeve to prevent rotatable movement of the expandable sleeve within the interior bore so that the cutter bit is retained at a fixed non-rotating position relative to the wear insert.

In another embodiment, the apparatus includes two retainers: an upper retainer and a lower retainer. The wear insert can include an interior bore to receive at least one cutter bit at a fixed position relative to the wear insert, a first portion proximate the upper surface of the base portion having a threaded portion and a second portion proximate the lower surface of the base portion having a threaded portion. A middle portion dimensioned to be received in the base portion opening can extend between the first and second portions. The upper retainer can have a gripping surface and a threaded portion threadably engageable with the threaded portion of the first portion of the wear insert. The gripping surface of the upper retainer can be configured to be rotated to engage and disengage the threaded portion of the upper retainer from the threaded portion of the first portion of the wear insert. The lower retainer can have a gripping surface and a threaded portion threadably engageable with the threaded portion of the second portion of the wear insert. The lower retainer can prevent the wear insert from translating longitudinally within the base portion. The gripping surface of the lower retainer can be configured to be rotated to engage and disengage the threaded portion of the lower retainer from the threaded portion of the second portion of the wear insert from the lower surface of the base portion.

Another embodiment of the apparatus for use on a portion of a milling or mining drum, adapted to be rotated in a cutting direction about a cylindrical axis defined by said drum is provided. The apparatus can include a base portion adapted to be mounted to the drum. The base portion can have an upper and lower surface, and an opening therebetween having a first seat proximate the upper surface. The apparatus can include an insert that is engageable with the base portion opening. The insert can include an interior bore to receive at least one cutter bit at a fixed position relative to the wear insert and an exterior surface. The cutter bit can have a cutting tip, a shank extending therefrom, and a threaded portion. The cutting tip can include a hardened tip comprising a hardened material attached to a substrate, such as diamond particles attached to a carbide substrate. The shank can include a transition disposed between the tip and the threaded portion. The transition can be tapered at various degrees, including a Morris taper. Optionally, the transition can be a polygonal shape, such as a hexagon for example. A portion of the exterior surface facing the base portion can be dimensioned to be received in the first seat of the base portion opening. A portion of the insert interior bore can be sized and shaped to engage securably with said transition of the cutter bit at a fixed position relative to the wear insert. The apparatus can include a retainer having a threaded portion to threadably engage with the threaded portion of the cutter bit. Because of the frictional engagement between the cutter bit and the insert and the insert and the base portion, the cutter bit is prevented from rotating during operation. Periodic manual rotation of the cutter bit can extend the life of the cutter bit by allowing wear to apply to several regions of the cutter bit.

One feature of an embodiment of the present invention is that the wear insert is capable of removable attachment to a base portion, yet resistant to loosening upon rotation of a mining drum. In some preferred embodiments, the opening is not tapped and the insert is locked within the opening with frictional engagement between the flange of the insert and the first seat and the retainer and the second seat of the opening. The non-tapped base portion opening eliminates the risk of damaged threads of the opening and the wear insert.

Another feature is that the cutter bit and/or the wear insert are designed to wear and fatigue more frequently than the base portion. This can decrease the time and costs of repair and replacement by allowing only the replacement of the less expensive cutter bit and/or wear insert. Further, some embodiments include inserts that are designed to wear and fatigue more frequently than the cutter bit. Some embodiments include configurations that substantially prevent the rotation of the cutter bit relative to the wear insert during operation. With the simplicity of the wear insert securably engaged with the base portion, and the seats and flanges provided therewith, the apparatus is durable and robust, yet easily and rapidly serviced.

Yet another feature of some embodiments of the present invention is the use of a cutter bit that includes a hardened tip that can include a diamond working end attached to a carbide substrate, the diamond working end having a pointed geometry. The diamond working end can comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The hardened tip can include other materials and/or compositions having a hardness similar to diamond. The hardened tip preferably comprises a material having a hardness greater than the hardness of the material of the cutter bit holding insert such that the insert wears earlier than the hardened tip. A cutter bit with such a hardened tip can be directly engaged with a base portion by a screw-threaded or other similar connection.

The above advantages, as well as other advantages of the present invention, will become readily apparent to those skilled in the art from the following detailed description of a preferred embodiment when considered in the light of the accompanying drawings.

BRIEF DESCRIPTION OF THE DRAWINGS

FIG. 5' is a side view depicting the engagement of the cutter bit and the insert of FIG. 5.

DESCRIPTION OF PREFERRED EMBODIMENTS

Figure 1:
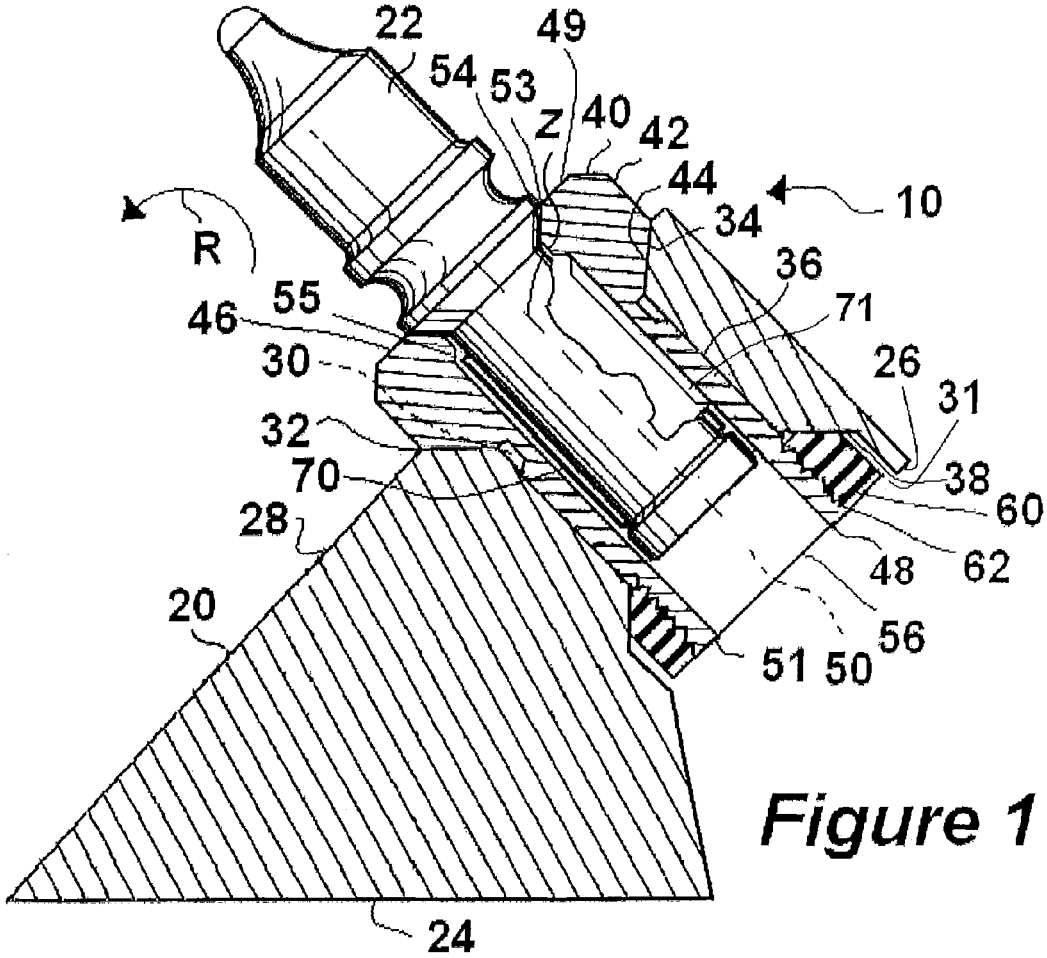
FIG. 1 is an enlarged, partial cross-sectional view of a base portion, a wear insert having a cutter bit, and a retainer.

With reference to all the Figures where reference numerals are generally used to identify like components, FIG. 1 illustrates one embodiment of an apparatus 10 for use on a portion of a cylindrical surface of a milling or mining drum, adapted to be rotated in a cutting direction R about a cylindrical axis defined by the drum. Optionally, the apparatus 10 can be used on flighting that is attached to the portion of the cylindrical surface portion of the drum. A base portion 20 can be mounted to the surface of the drum or to the flighting, for instance by bolting or welding. The base portion 20 can include at a cutter bit 22 at the radially outward extremity of the base portion 20. The cutter bit 22 can be cylindrically shaped with a conical tip, which typically a hardened portion, which is directed forward in the direction R. The hardened tip can include carbide or other compositions described below. Cutter bits 22 can forcibly contact a surface to be mined or milled and, in a known manner, mine, mill, or reclaim a controlled portion of such surface. As a result, this can leave such surface substantially planar with a slightly roughened surface texture.

The base portion 20 includes a body having at least a mounting surface 24. The base portion 20 can be mounted to a radially outermost portion of the drum or flighting sections, so that the mounting surface 24 is adjacent to the radially outermost portion. Side welds can attach together adjacent base portions 20 and, in addition, help prevent loosened roadway material from moving between adjacent base portions. The body of the base portion 20 can also include a lower surface 26 and an upper surface 28. The lower and upper surfaces 26, 28 can be generally parallel with respect to one another.

Figure 2:
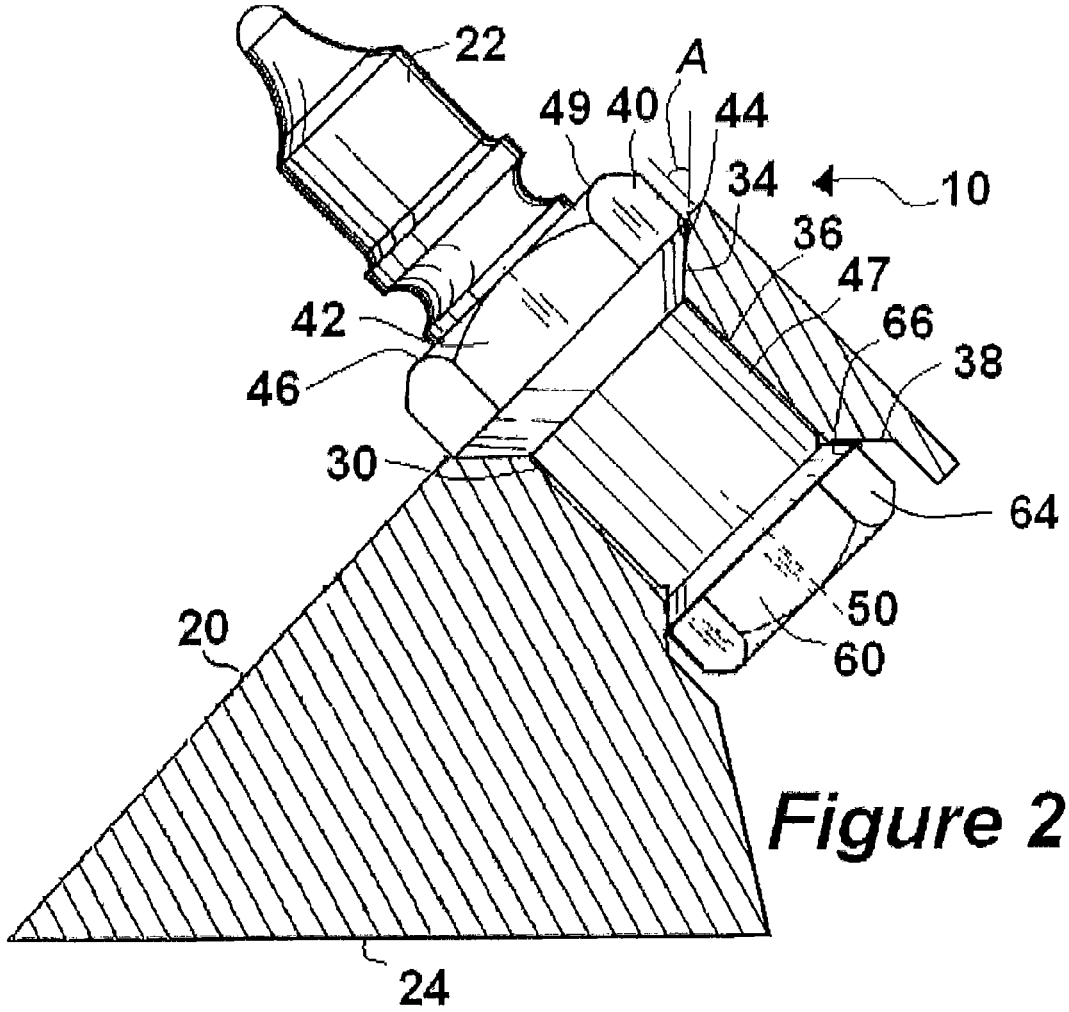
FIG. 2 is an enlarged, partial cross-sectional view of the base portion of FIG. 1 depicting the exterior of the wear insert and the retainer.

The base portion 20 can define an opening 30 that is aligned with a longitudinal axis Z running therethrough. The opening 30 can be adapted to receive a wear insert 40 for retaining the cutter bit 22. The opening 30 of the base portion 20 includes a lower end 31 and an upper end 32 that may have a first seat 34, preferably a conical seat, located at the upper end 32 of the base portion opening 30. The base portion opening 30 can also include a second seat 38, preferably a conical seat, proximate the lower end 31 of the base portion opening 30. The first and/or second seat 34, 38 can be tapered at an angle A in the range between about 5 to about 70 degrees, preferably about 20-50 degrees, relative to the longitudinal axis Z, as shown in FIG. 2. Preferably, the angles A of tapering for the first and second seats 34, 38 are substantially similar. Between the upper and lower ends 31, 32, or optionally the first and second seats 34, 38, is a middle portion 36 that can define a substantial portion of the base portion opening 30.

Figure 3:
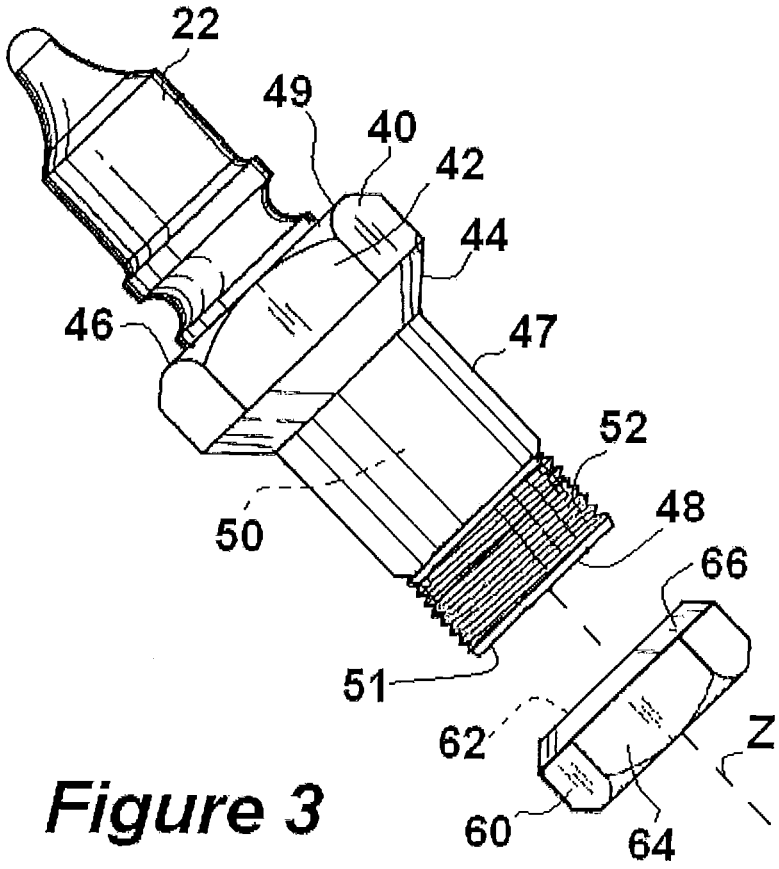
FIG. 3 is a side view of a wear insert having a cutter bit longitudinally isolated from a retainer, depicted without a base portion.

Referring to FIGS. 1-3, the wear insert 40 can include a nut-like gripping surface 42 proximate the upper surface 28 of the base portion 20 and a flange 44 extending from the nut-like gripping surface 42 to a middle portion 47. The flange 44 can frictionally engage with the base portion first seat 34. Preferably, the flange 44 is a conical shoulder having the same tapering rate as the angle A of the first seat 34. The wear insert 40 can have a first end 46 and a second end 48. The first end 46 is positioned at an upper surface 49 of the wear insert 40 away from the mounting surface 24, and the second end 48 is positioned at a lower surface 51 of the wear insert 40 proximate the mounting surface 24. The second end 48 can project beyond the lower surface 26 of the base portion 20. Between the first and second ends 46, 48 is the middle portion 47 that preferably slidably engages with at least a substantial portion of the middle portion 36 of the opening 30 of the base portion 20. The wear insert 40 can also include threads 52 extending from the middle portion 47 to the second end 48 of the wear insert 40. For example, FIG. 3 illustrates the wear insert 40 having external threads. Alternatively, the wear insert 40 can have internal threads.

The wear insert 40 can slidably engage with the opening 30 of the base portion 20, until the flange 44 of the wear insert 40 is disposed in wedged frictional contact against the first seat 34 of the base portion 20. A retainer 60 can be provided to securably engage the wear insert 40 within the base portion opening 30. As a result, the wear insert 40 can be secured to the base portion 20, which can keep the threads 52 of the wear insert 40 from being under shock load of the cutting operation. The nut-like gripping surface 42 of the wear insert 40 can allow for easy access for removal of the wear insert 40. The wear insert 40 can be formed of material that is not welded and can therefore maintain hardness.

In FIGS. 1 and 2, the wear insert 40 includes an interior bore 50. The interior bore 50 can be sized for receiving at least one cutter bit 22. As illustrated in FIG. 1, the interior bore 50 can have a first end 54 positioned proximate the first end 46 of the wear insert 40 and a second end 56 proximate the second end 48 of the wear insert 40. The first end 54 of the interior bore 50 is for removably receiving the cutter bit 22.

An expandable cylindrical sleeve 70 can also be provided to frictionally engage the wear insert 40, thereby preventing the cutter bit 22 from translating within the interior bore 50 of the wear insert 40. The expandable sleeve 70 is attached around a shank portion of the cutter bit 22, with the expandable sleeve 70 being normally in an expanded state. The cutter bit 22 with the expandable sleeve 70 can be forcibly inserted into the interior bore 50, which causes the expandable sleeve 70 to move between the expanded state and a compressed state to frictionally engage the cutter bit 22 and the surface of the interior bore 50. The combined cross-sectional area of the shank of the cutter bit 22 and the expandable sleeve 70 should be slightly less than the cross-sectional area of the interior bore 50 to ensure securable engagement within the interior bore 50. The threads 52 of the wear insert 40 and the interior bore 50 of wear insert can be disposed substantially coaxially.

In some embodiments, the interior bore 50 can also include a key or other protrusion 71 to engage with the expandable sleeve and prevent rotation therein. For example, in the partial cut away in FIG. 1, the protrusion 71 is a raised portion extending longitudinally through the interior bore, although the protrusion can be a series of protrusion and/or can be disposed within various locations within the interior bore. The protrusion 71 can engage a nipple, raised portion, or longitudinal edge of the expandable sleeve 70 to further inhibit rotation of the sleeve 70 relative to the bore 50. Rotation of the sleeve 70 is caused by the rotation of the cutter bit 22 during operation. Rotatable movement of the sleeve 70 within the interior bore 50 may cause undesirable wear and tear to the bore of the wear insert 40.

The interior bore 50 can also include an entry opening 53. The entry opening 53 preferably is a conical opening having a first end proximate the first end 54 of the interior bore 50, which can engage a flange of the cutter bit 22. The cross-sectional area of the interior bore 50 can be greater than the cross-sectional area of a second end positioned lower than the first end of the entry opening 53. The interior bore 50 preferably has a circular cross-sectional area.

In some embodiments, the interior bore 50 may have an internal flange 55 with a reduced cross-sectional area as compared to a substantial portion of the interior bore 50. FIG. 1 illustrates the internal flange 55 having a cross-sectional area slightly less than the cross-sectional area of the cutter bit 22 in order to reduce the likelihood of abrasive dust entering into the interior bore 50 and to further secure the expandable sleeve 70 within the interior bore 50. Although the lower portion of the edge of the internal flange 55 is shown in FIG. 1 to be a chamfered edge to facilitate the removal of the expandable sleeve 70, the lower portion of the internal flange 55 can be square or perpendicular. The chamfered edge can urge the expandable sleeve 70 to radially compress to the compressed state, i.e., a cross-sectional area that is small enough to permit withdrawal. The angle of the chamfered edge can be about 30 degrees to about 60 degrees; however, it can be appreciated by one skilled in the art that the angle can be any degree suitable to retain the expandable sleeve 70 in one aspect, and to urge the expandable sleeve 70 to the compressed state in another aspect. In other embodiments, the cross-sectional area of the interior bore 50 can be substantially the same throughout, and a step ring can be attached, preferably by brazing, welding or the like, at a region near the first end 54 of the interior bore 50. The step ring has an outer edge with a cross-sectional area substantially similar to the cross-sectional area of the interior bore 50 and an inner edge with a cross-sectional area that is less than the cross-sectional area of the outer edge. The material of the step ring can be made of metal known in the art, and preferably, hardened steel or carbide. The step ring can perform the same function, and can also have the chamfered edge, similar to the internal flange 55 described above.

As mentioned previously, the retainer 60 can be provided to securably engage the wear insert 40 within the base portion opening 30. Referring to FIG. 3, the retainer 60 can include threads 62 to threadably engage the threads 52 of the wear insert 40. Although FIG. 3 illustrates the retainer 60 having internal threads, the retainer 60 optionally can have external threads. The retainer 60 can also include a gripping surface 64 to rotatably engage and disengage the retainer threads 62 from the threads 52 of the wear insert 40. The retainer 60 can also include a flange 66 that can be frictionally engaged with the second seat 38, as shown in FIG. 2. The retainer flange 66 can be angled at various angles, including the range between about 10 to about 70 degrees, preferably about 20-50 degrees, relative to the longitudinal axis Z. Preferably, the retainer flange 66 is a conical shoulder. The tapering angle of the wear insert flange 44 and the retainer flange 66 can be substantially similar as the tapering rate of the first and second seats 34, 38, respectively. At least a portion of the retainer 60 can be accessible from the lower surface 26 of the base portion 20, where a tool can rotatably engage and disengage the retainer threads 62 from the wear insert threads 52. The retainer 60 can be a specifically machined part designed according to specification or can be a conventional fastener, preferably a hexagonal nut fastener that is modified with the retainer flange 66. As shown in FIGS. 1 and 2, the retainer 60 is preferably entirely within the base opening 30 in order for portions of the base 20 to protect the retainer 60 from wear and tear and to reduce the risk of dust or debris from entering the retainer 60. There can be enough gap or separation between the retainer 60 and the base 20 to permit a suitable tool to engage the retainer 60.

Also provided is a method of replacing a wear insert 40 and/or cutter bit 22. Damage to the cutter bit 22 and/or the wear insert 40, instead of the base portion 20, is more desirable because the cutter bit 22 and/or the wear insert 40 are less expensive to replace. The cutter bit 22 and/or wear insert 40 can become damaged by wear and tear due to the abrasive forces being transmitted to the wear insert 40 via the cutter bit 22. Oftentimes, the forces are unevenly distributed between the cutter bits 22 and wear insert 40, which causes the cutter bit 22 to vibrate and otherwise move and rotate within the wear insert interior bore 50. Particularly, in the presence of abrasive dust from the roadway surface reclaiming operation, the vibration and movement of the cutter bit 22 act to such an extent that the cutter bit 22 is no longer retained. Even worse, the forces occasionally become constant enough to fatigue or large enough damage the cutter bits 22 and/or the wear insert 40 causing the machine to be stopped for considerable lengths of time, such as 2-40 hours, for repair and replacement of the base portions 20, cutter bits 22, wear inserts 40, or all. When only the cutter bit 22 needs replacing, the cutter bit 22 with the expandable sleeve 70 can be punched out of the interior bore 50 of the wear insert 40 by inserting a first tool into the second end 56 of the interior bore 50 of the wear insert 40 to contact the lower end of the cutter bit 22. A second tool can then hammer the inserted first tool to punch out forcibly the cutter bit 22 with the expandable sleeve 70 from the first end 54 of the interior bore 50 of the wear insert 40. A replacement cutter bit with the expandable sleeve can then be inserted into the first end 54 or entry opening 53 of the interior bore 50 of the wear insert 40 by hammering the top end of the replacement cutter bit to punch in the replacement cutter bit within the interior bore 50 of the wear insert 40.

The wear insert 40 can be replaced with the following steps. The wear insert 40 can be damaged by wear and tear of the interior bore 50 due to abrasive dust or a loosened cutter bit, or by wear and tear of the threads 52 and/or the nut-like gripping surface 42. FIG. 2 illustrates the apparatus 10 having the base portion 20, a wear insert 40, depicted with the cutter bit 22 before being replaced. The cutter bit 22 with the expandable sleeve 70 may be punched out from engagement with the interior bore 50 of the wear insert 40 before removing the wear insert 40. One step can include engaging an appropriate tool (not shown), such as a socket, with the retainer 60 from the lower surface 26 of the base portion 20. Once the appropriate tool is securably engaged with the gripping surface 64 of the retainer 60, the appropriate tool can be rotated with sufficient force in an appropriate direction to remove the retainer 60, as illustrated in FIG. 3. If rotation of the appropriate tool causes the rotation of the wear insert 40 in the same direction, another tool (not shown), such as a socket, can be securably engaged with the nut-like gripping surface 42 of the wear insert 40 to prevent the wear insert 40 from rotating. Once the tool is engaged with the wear insert 40, the threads 52 of the wear insert 40 can be disengaged from the threads 62 of the retainer 60. The wear insert 40 can then be removed from the base portion 20.

Accordingly, the wear insert 40 is removed and a replacement wear insert can be installed with the aforementioned steps in reverse order. The wear insert 40 can slidably engage with the opening 30 of the base portion 20, until the flange 44 of the wear insert 40 is disposed in wedged frictional contact against the first seat 34 of the base portion 20. The retainer 60 can be then inserted around the threads 52 of the wear insert 40. An appropriate tool can be securably engaged with the retainer 60 to rotate the retainer 60 with sufficient force in an appropriate direction to tighten the retainer 60. If rotation of the appropriate tool causes the rotation of the wear insert 40 in the same direction, another tool can be securably engaged with the nut-like gripping surface 42 of the wear insert 40 to prevent the wear insert 40 from rotating. Consequently, the wear insert 40 can be secured to the base portion 20, which can keep the threads 52 of the wear insert 40 from being under shock load of the cutting operation. The replacement cutter bit can be forcibly inserted or punched into the interior bore 50 of the wear insert 40 after the wear insert 40 is securably engaged with the base portion 20.

Figure 4:
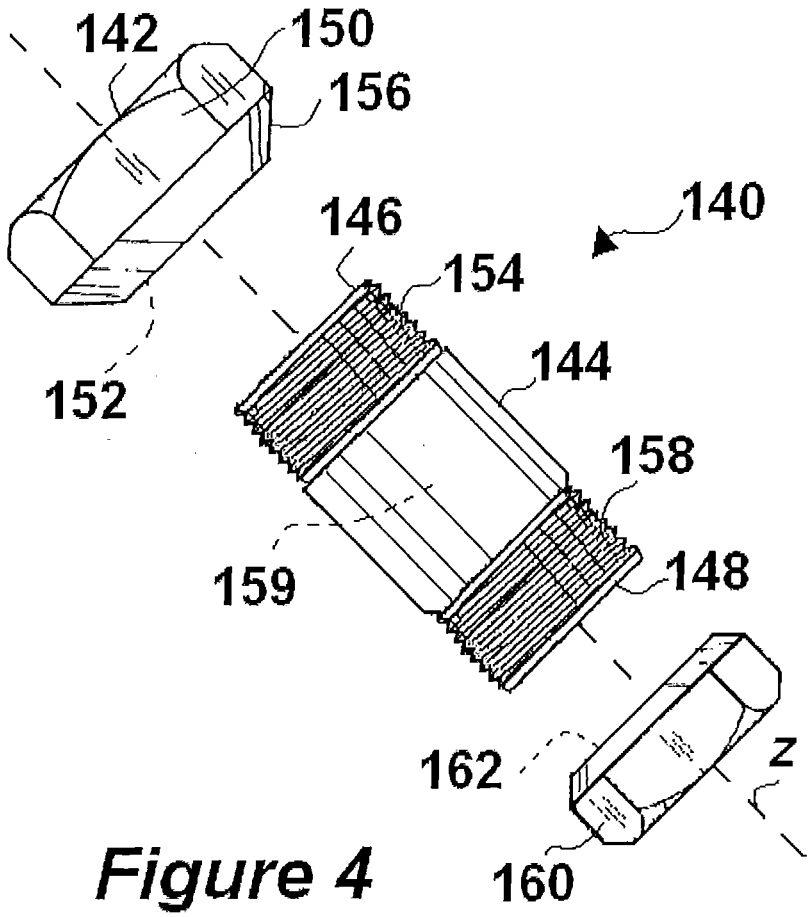
FIG. 4 is a side view of an alternative wear insert longitudinally isolated from an upper and a lower retainer.

In another embodiment of the wear insert 140, two retainers, an upper retainer 142 and a lower retainer 160, may be removably attached to a portion of a shank 144 of the wear insert 140, as shown in FIG. 4. The wear insert 140 is similar to the wear insert 40 described herein except for the following. The shank 144 of the wear insert 140 includes a threaded portion at the upper end 146, in addition to the lower end 148. The upper retainer 142 can have a nut-like configuration including a gripping surface 150 on the exterior and internal threads 152. The internal threads 152 can threadably engage with the threads 154 of the upper end 146 of the shank 144. Optionally, the upper retainer 142 can have a portion extending from the gripping surface 150 that has external threads, which can be threadably engaged with internal threads of the upper end 146 of the shank 144. The upper retainer 142 also includes a flange 156 extending from the gripping surface 150 that can frictionally engage with the first seat 34 of the base portion 20. The lower retainer 160 is similar to the retainer 60 as described herein. The lower retainer 160 has threads 162 that can engage with the threads 158 at the lower end 148 of the shank 144. The threads 158, 154 can be machined in the same or opposite direction. A cutter bit can be forcibly inserted in or removed from the wear insert 140 without removing the upper retainer 142 by punching in or out the cutter bit into the interior bore 159 with an appropriate tool. If the upper retainer 142 is removed, after a replacement cutter bit is inserted into the interior bore 159 of the wear insert 140, the upper retainer 142 can be reattached to the shank 144 of the wear insert 140.

Figure 5:
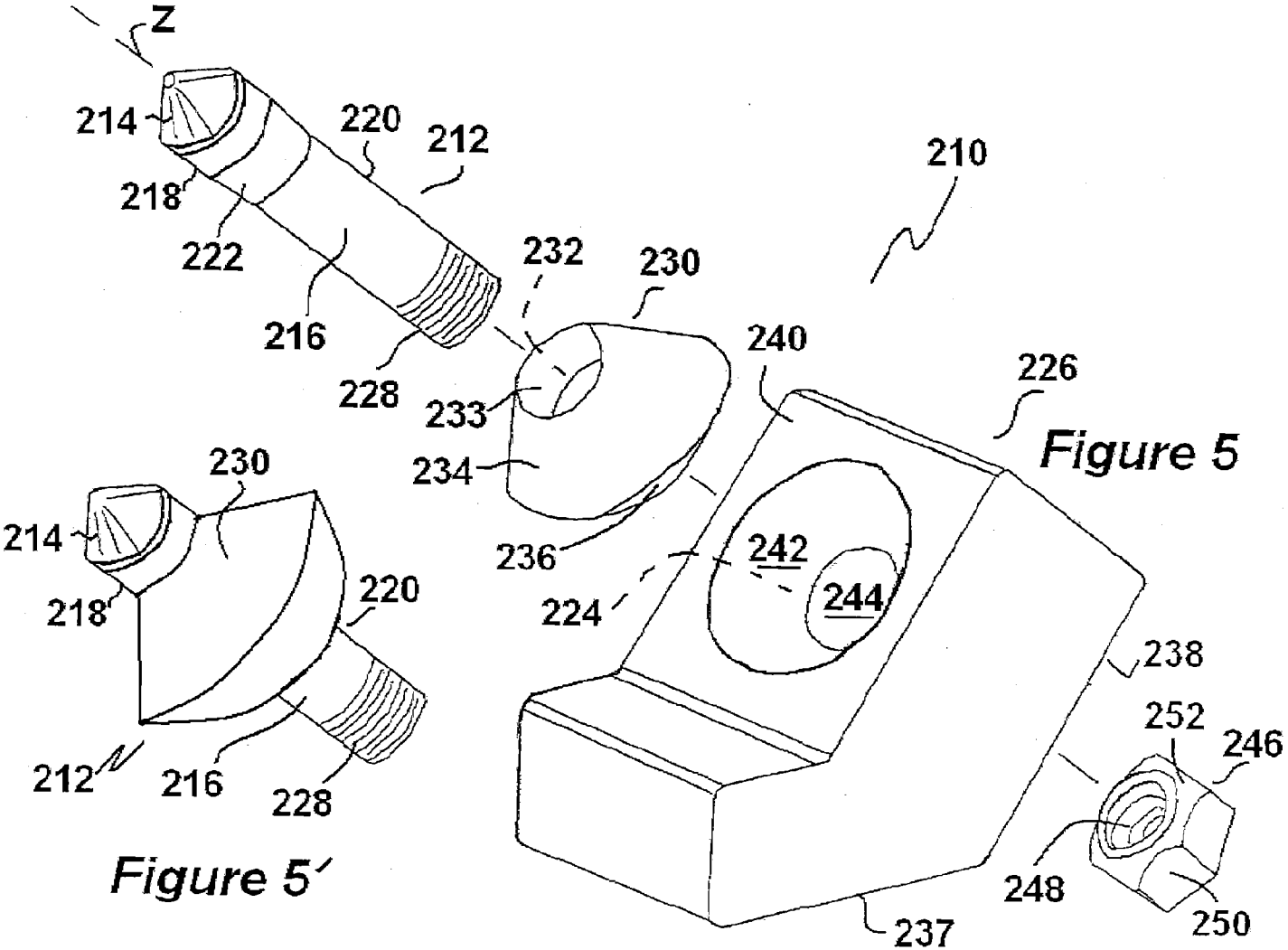
FIG. 5 is a perspective view depicting an embodiment of a base portion, an insert, a cutter bit, and a retainer.

FIG. 5 illustrates another embodiment of the apparatus 210 for use on a portion of a cylindrical surface of a milling or mining drum. The cutter bit 212 includes a hardened tip 214. The hardened tip 214 may include a diamond working end attached to a carbide substrate, the diamond working end having a pointed geometry. The diamond working end may comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The hardened tip 214 may include other materials and/or compositions having a hardness similar to diamond. The hardened tip 214 preferably comprises a material having a hardness greater than the hardness of the material of the insert 230, such that the insert wears earlier than the hardened tip.

The shank portion 216 of the cutter bit includes various regions of different diameters. For example, the shank portion 216 can include a tip region 218 having a diameter and a base region 220 having a diameter less than the tip region diameter and a transition 222 therebetween. The tip region 218 is attached to the hardened tip 214. The transition 222 is tapered at a small angle between 2-10 degrees and is preferably a Morris taper. The base region 220 of the shank portion is sized to slide through the opening 224 of the base portion 226. The base region 220 can also include a threaded portion 228.

The insert 230 includes a bore 232 having a first region 233 dimensioned to engage with the transition 222 of the shank portion 216 of the cutter bit 210. The engagement between the first region 233 of the insert bore and the transition 222 of the shank portion of the cutter bit provides substantially non-rotatable movement therebetween, and "locks" the two members together. A locking engagement between the first region 233 of the insert bore and the transition 222 of the shank portion of the cutter bit can also be provided by threads or splines on both surfaces. The bore 232 can include a second region with a diameter sized to slidably receive the base region 220 of the shank portion 216 of the cutter bit 210. The insert 230 can also include tapered regions on the exterior. The exterior portion 234 facing the tip region 218 can be tapered, or conically or spherically shaped, in order to better deflect debris when in operation. The exterior portion 236 facing away from the tip region can be tapered, or conically or spherically shaped, in order to better engage with the base portion 226. The engagement between exterior portion 236 of the insert 230 and a first seat 242 of the base portion opening 224 provides substantially non-rotatable movement therebetween, and "locks" the two members together. The insert 230 can be made of softer material than the hardened tip 214 of the cutter bit 210 in order to wear earlier than the cutter bit 210. The insert 230 can function as a deflector of debris away from the base portion and frictional inducing member to retain the cutter bit and to be retained by the base portion.

The base portion 226 includes a body having a mounting surface 237 and a lower surface 238 and an upper surface 240. The base portion 226 can be mounted and attached, as described above, to a radially outermost portion of the drum or flighting sections such that the mounting surface 237 is adjacent to the radially outermost portion. The base portion opening 224 is aligned with a longitudinal axis Z running therethrough. The opening 224 can be adapted to receive the insert 230 and a portion of the cutter bit 212. A first seat 242, preferably a conical seat or spherical seat, may be located at the upper end 240 of the base portion opening 224. A second seat (not shown), preferably a conical seat or spherical seat, is proximate the lower end of the base portion opening. The first seat and/or second seat can be tapered at an angle in the range between about 5 to about 70 degrees, preferably about 20-50 degrees, relative to the longitudinal axis Z. Preferably, the angle of tapering for the first and second seats is substantially similar. Between the upper and lower ends, or optionally the first and second seats, is a middle portion 244 that can define a substantial portion of the base portion opening 224. The middle portion 244 of the opening 224 is sized to slidably receive a portion of the shank portion 216 of the cutter bit 212.

The retainer 246 can threadably engage with the threaded portion 238 of the cutter bit 212 after being inserted through the base portion opening 224. The retainer 246 can include a threaded portion 248 dimensioned to threadably engage the threaded portion 228 of the cutter bit 212. The retainer 246 can also include a gripping surface 250 to rotatably engage and disengage the retainer threaded portion 248 from the threaded portion 228 of the cutter bit 212. The retainer 246 can also include a flange 252 that can be frictionally engaged with the second seat of the base portion opening 224. The retainer flange 252 can be angled at various angles, including the range between about 10 to about 70 degrees, preferably about 20-50 degrees, relative to the longitudinal axis Z. Preferably, the retainer flange 252 is a conical shoulder. At least a portion of the retainer 246 can be accessible from the lower surface 238 of the base portion 226 such that a tool can rotatably engage and disengage the retainer threaded portion 248 from the cutter bit threaded portion 228. In some embodiments, the retainer 246 is a specifically machined part designed according to specification or can be a conventional fastener, preferably a hexagonal nut fastener that is modified with the retainer flange 252. In some embodiments, the retainer 246 is entirely within the base portion opening 224 in order for portions of the base portion 226 to protect the retainer 246 from wear and tear and to reduce the risk of dust or debris from entering the retainer 246, similar to what is illustrated in FIG. 2. There can be enough gap or separation between the retainer 246 and the base portion 226 to permit a suitable tool such as a socket or wrench to engage the retainer.

A method of assembling the embodiment of the apparatus 210 is also included. With reference to FIG. 5, the shank portion 216 of the cutter bit 212 can be inserted through the bore 232 of the insert 230 and axially moved therethrough such that the transition 222 of the cutter bit 212 and the insert 230 engage. FIG. 5' is a side view depicting the engagement of the cutter bit 212 and the insert 230. With securable engagement between the insert 230 and the cutter bit 212, the shank portion 216 can be inserted through the base portion opening 232 such that the threaded portion 228 of the cutter bit 212 is accessible from the lower end. With the exterior portion 236 of the insert 230 securably engaged with the first seat 242 of the base portion opening 224, the retainer 246 can then be threadably engaged with the cutter bit 212 and suitably tightened. With the apparatus assembled, the cutter bit 212 thereby is prevented from rotating during operation. This prevention is due primarily to the surface area contact and frictional contact between the cutter bit 212 and the insert 230 and the insert 230 and the base portion 224. Lack of rotation can be acceptable due to the hardness of the hardened tip and its ability to absorb the operational forces. To disassemble, the aforementioned steps can be reversed. Disassembling may be required periodically in order to promote wearing evenly around the hardened tip. Accordingly, the cutter bit 212 and/or the insert 230 can be manually rotated in order to distribute the wear and tear of the hardened tip to other regions. In addition, the insert 230 may wear before the cutter bit 212 and thus may be replaced with a new insert.

Figure 6:
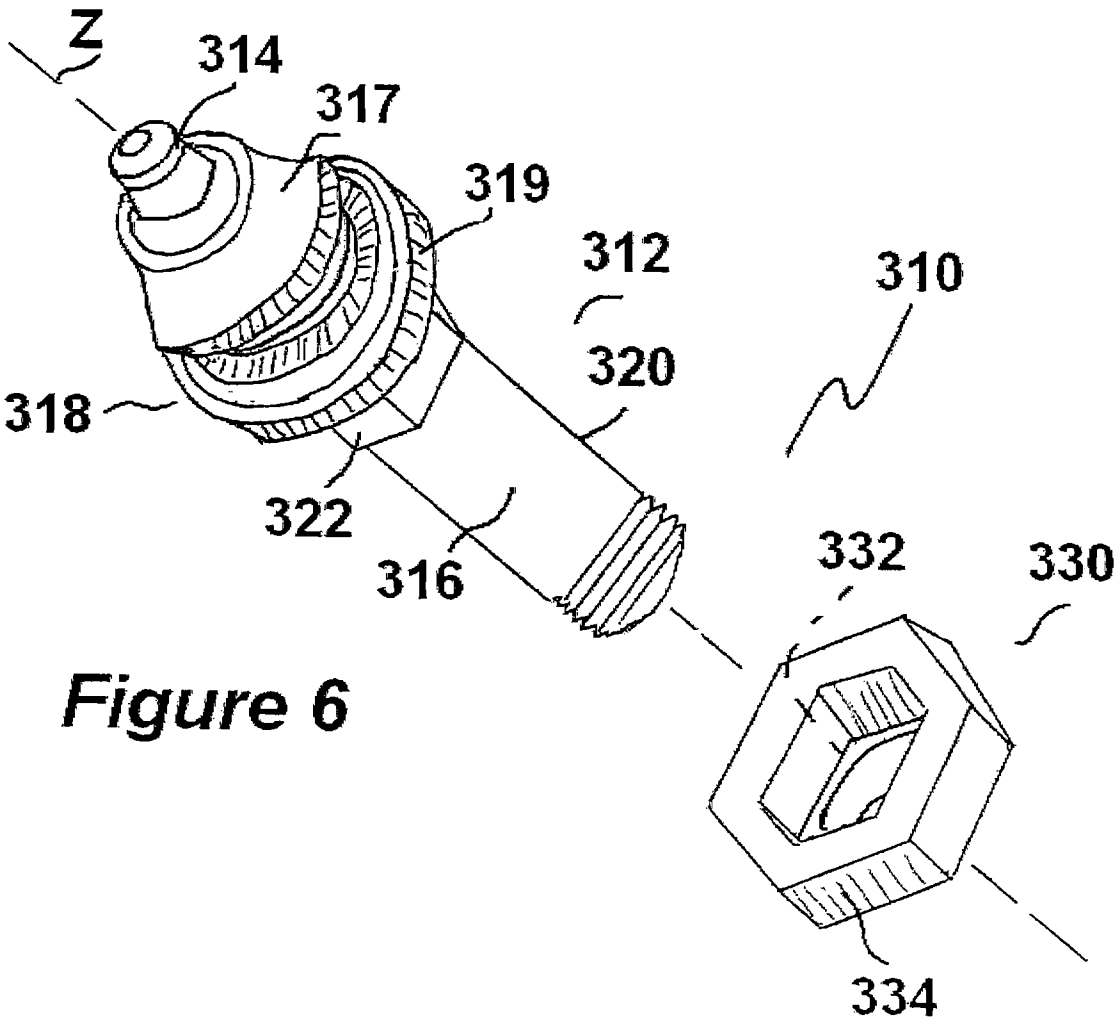
FIG. 6 is a perspective view depicting another embodiment of a cutter bit and a retainer.

FIG. 6 illustrates another embodiment of the apparatus 310 which is substantially similar to the apparatus 210 except with the differences described below. The tip region 318 includes the hardened tip 314 that is attached to a conical section 317 extending axially therefrom and a flange 319. The shank portion 316 of the cutter bit 312 can have a polygonal shaped portion 322 between the flange 319 of the tip region 318 and the base region 320. The polygonal shaped portion 322 can have a larger cross-sectional area than the cross-sectional area of the base region 320. A portion of the insert bore 332 of the insert 330 is shaped to be substantially identical to the polygonal shaped portion 322 of the cutter bit 312 in order to be received when inserted through the bore. The number of sides of the polygonal shaped portion 322 can dictate the degree of rotation of the cutter bit. For example, a hexagon (six sides) is shown in both the insert bore 332 and the polygonal shape portion 322 of the cutter bit 312. Thus, the cutter bit 312 can be rotated in 60-degree (360 degrees/6 sides) increments. A portion 334 of the exterior surface of the insert 330 may also be polygonally shaped, which is shown in FIG. 6 as a hexagon. A portion of the exterior surface of the insert facing away from the tip region 318 can be tapered, or conically or spherically shaped, in order to better engage with the base portion opening 224.

Figure 7:
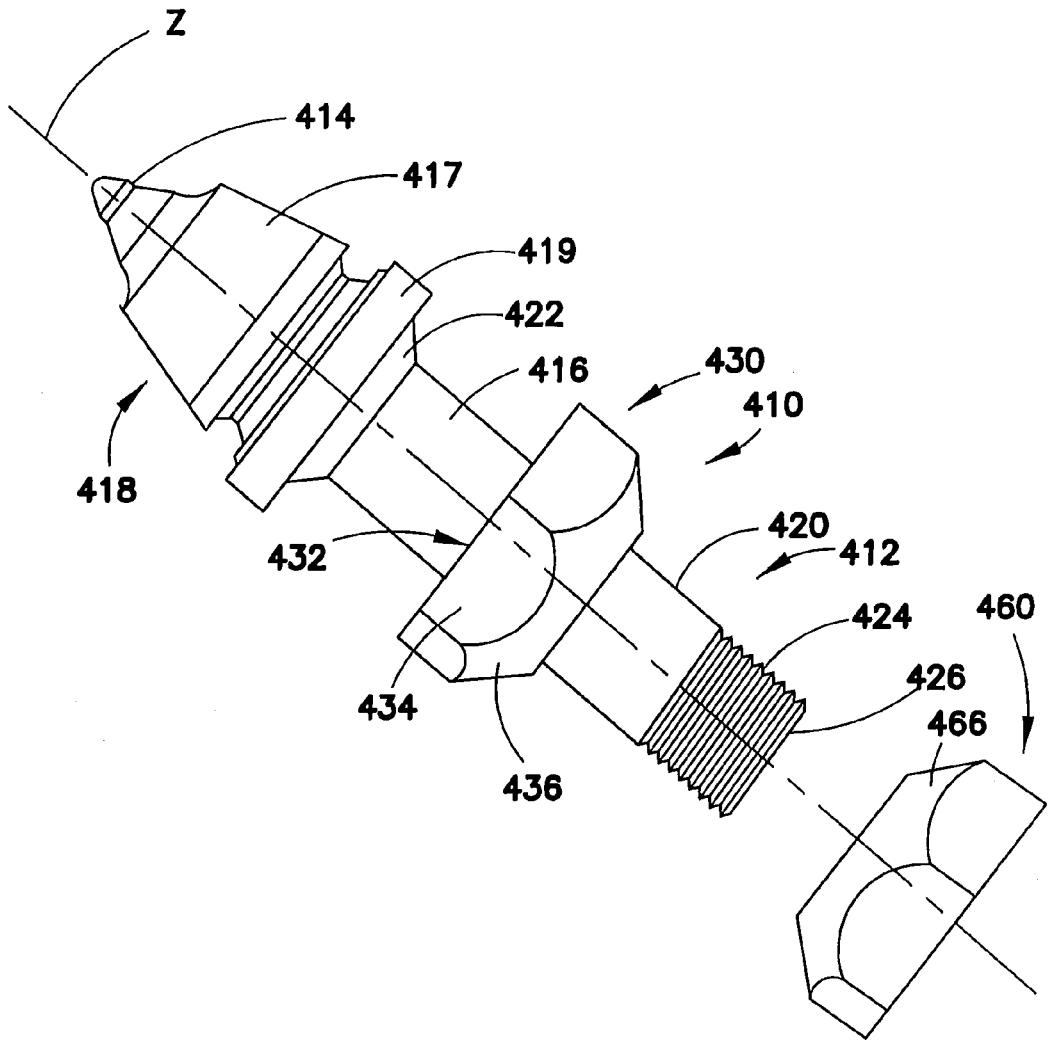
FIG. 7 is a side view depicting another embodiment of a cutter bit and a retainer.

FIG. 7 illustrates another embodiment of the apparatus 410 which is substantially similar to the apparatuses 210, 310 except with the differences described below. The tip region 418 includes the hardened tip 414 that is attached to a conical section 417 extending axially therefrom and a flange 419. The transition 422 of the shank portion 416 of the cutter bit 412 can be tapered between the flange 419 of the tip region 418 and the base region 420 at an angle larger than the Morris taper. For example, the transition 422 can be tapered at an angle in the range between about 10 to about 70 degrees, preferably about 20-50 degrees, relative to the longitudinal axis Z. Threads 424 can be provided at a lower end 426 of the shank portion 416. The bore 432 of the insert 430 can have two regions (not shown in the figures) shaped to be substantially identical to shank portion 416 of the cutter bit 412 in order for the cutter bit to be received in the bore when inserted therethrough. The first region of the bore 432 is sized to receive and engage with the transition 422 of the cutter bit 412, having a taper substantially identical to the taper of the transition 422. The second region of the bore 432 is sized to receive the base region 420 of the cutter bit 412. A portion 434 of the exterior surface of the insert 430 facing the tip region 418 may be polygonally shaped, with FIG. 7 depicting one embodiment as a hexagon. A portion 436 of the exterior surface of the insert 430 facing away from the tip region 418 can be tapered, or conically or spherically shaped, in order to better engage with the base portion opening 224. In other examples, the insert 430 can be omitted, and the transition 422 of the cutter bit 412 can engage with the base portion opening 224. A lower retainer 460 can also be provided having threads that can engage with the threads 424 at the lower end 426 of the shank portion 416. The threads 424 on the shank portion 416 and the threads in the lower retainer can be machined in either direction to provide right or left locking engagement. The lower retainer 460 can include a flange 466 that can be frictionally engaged with the second seat 38, as shown in FIG. 2. The retainer flange 466 can be angled at various angles, including the range between about 10 to about 70 degrees, preferably about 20-50 degrees, relative to the longitudinal axis Z. Preferably, the retainer flange 466 is a conical shoulder. The threads 424 on the shank portion 416 can alternatively engage a threaded interior bore 50 of a base 20 as shown, for example, in FIG. 9.

Figure 8:
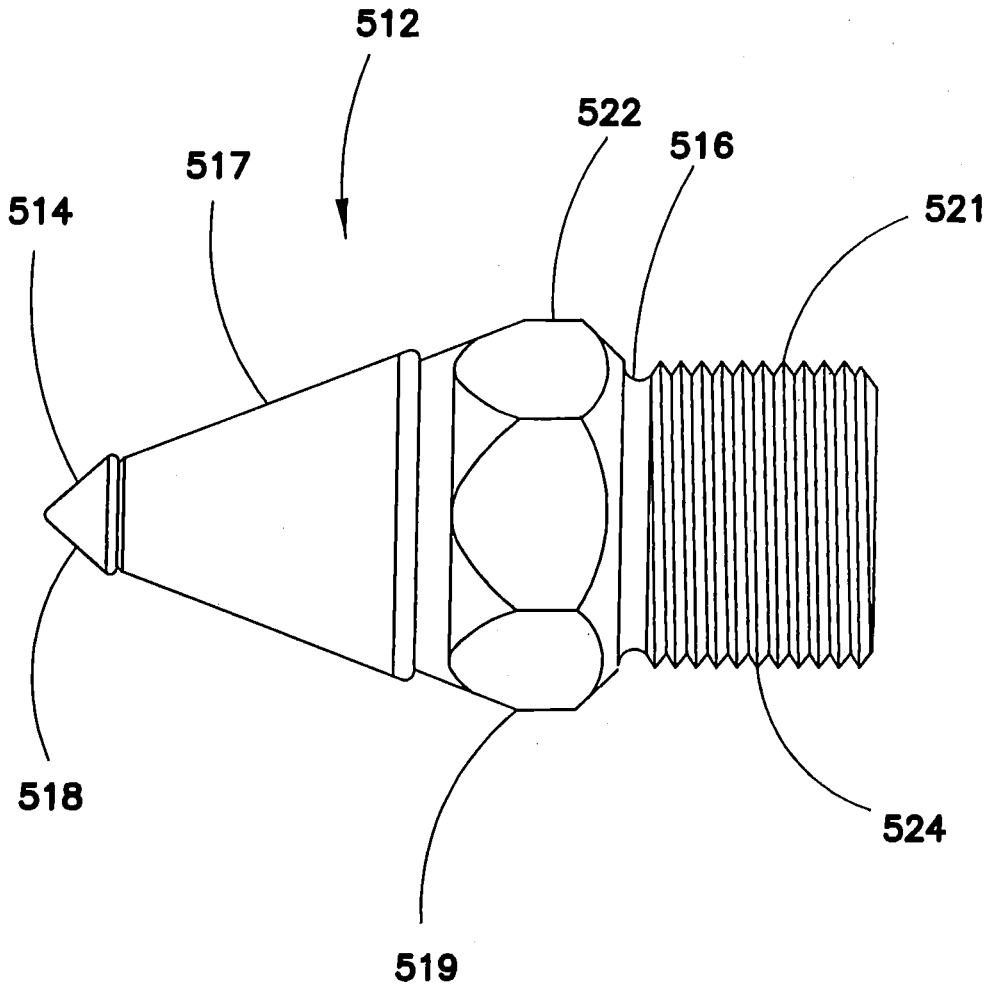
FIG. 8 is a side view depicting another embodiment of a cutter bit that can be engaged with a retainer or directly with a base.
Figure 9:
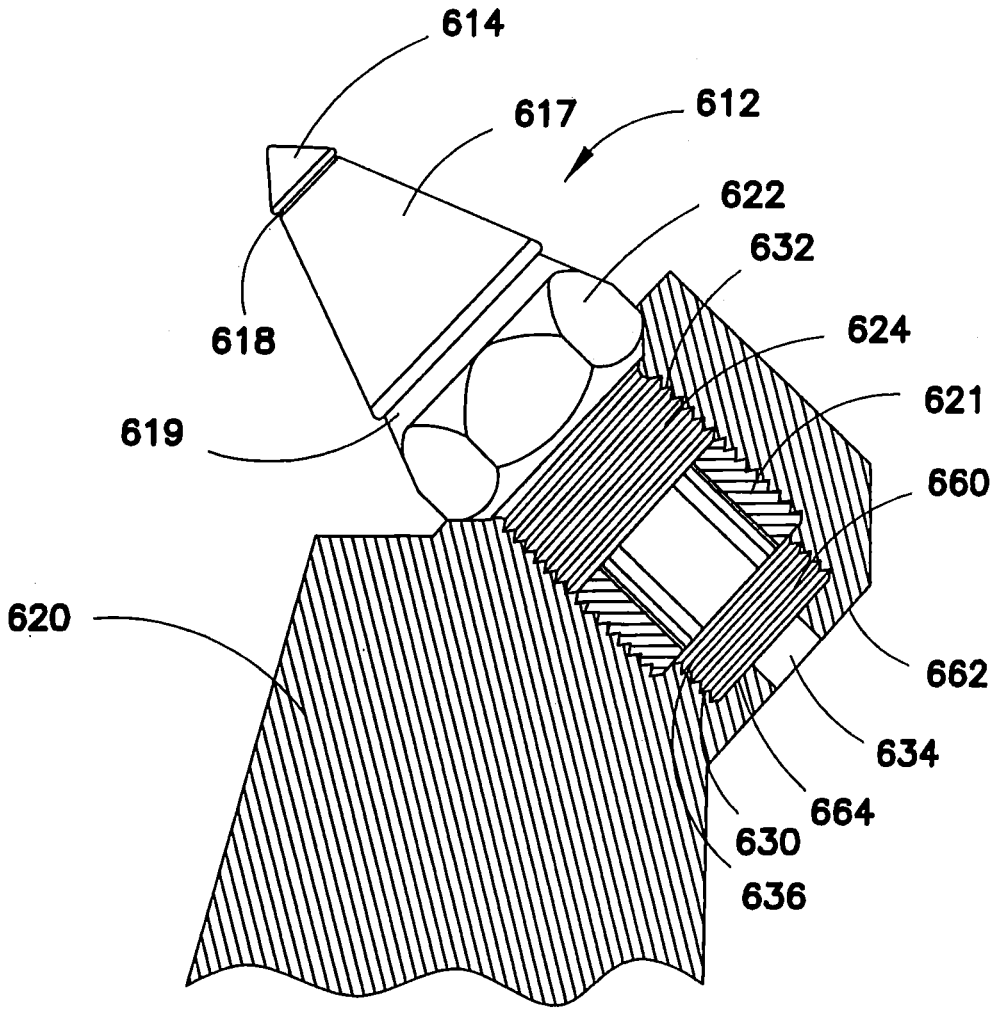
FIG. 9 is a side view of another embodiment of a cutter bit shown engaged with a base and retainer shown in section.

FIG. 8 shows a side view depicting another cutter bit 512 that includes a shank portion 516 having threads 524 on a base portion 521 that can engage a suitable retainer as shown, for example, in FIG. 5, or can engage directly with a base as shown, for example, in FIG. 9. The cutter bit 512 can include a tip region 518 supporting a hardened tip 514. The tip region 518 is attached to an outwardly tapered conical region 517 leading to a flange portion 519. The flange portion 519 can include a nut-like configured gripping surface 522. Like the embodiment shown in FIG. 5, the hardened tip 514 can include a diamond working end attached to a carbide substrate, the diamond working end having a pointed geometry. The diamond working end can comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The hardened tip 514 can also include other materials and/or compositions having a hardness similar to diamond.

FIG. 9 shows a side view of another embodiment of a cutter bit 612 shown engaged with a base 620 and retainer 660 shown in section. The cutter bit 612 is similar in construction to the cutter bit 512 shown in FIG. 8. The cutter bit 612 includes threads 624 on a base portion 621 that can engage directly with the base 620. The cutter bit 612 can include a tip region 618 supporting a hardened tip 614. The tip region 618 is attached to an outwardly tapered conical region 617 leading to a flange portion 619. The flange portion 619 can include a nut-like configured gripping surface 622. Like the embodiments shown in FIG. 5 and FIG. 8, the hardened tip 614 can include a diamond working end attached to a carbide substrate, the diamond working end having a pointed geometry. A retainer 660 can be internally threaded into a lower end 630 of the threaded opening 632 of the base 620. The retainer 660 can have a working engagement surface 662 at a lower end 664 of the retainer 660, which can be accessed through an opening 634 in the base. The retainer 660 can have an outside thread 636 that is smaller than and threaded opposite the opposite direction to the threads 624 on the cutter bit 612. After insertion of the cutter bit 612 into the base 620, the retainer 660 can be advanced into locking engagement with the lower end of the cutter bit 612.

In accordance with the provisions of the patent statutes, the present invention has been described in what is considered to represent its preferred embodiment. However, it should be noted that the invention can be practiced otherwise than as specifically illustrated and described.

The invention claimed is:

1. An apparatus for use on a portion of a milling or mining drum, adapted to be rotated in a cutting direction about a cylindrical axis defined by said drum, the apparatus comprising:

a base portion adapted to be mounted to said drum, comprising an upper surface and a lower surface, and an opening having a first seat proximate the upper surface;

a cutter bit including a tip region having a working end attached to a carbide substrate, the working end having a pointed geometry and having a hardness similar to diamond, the cutter bit further including a flange having a nut-like gripping surface and a shank portion extending away from the tip region to a distal end, at least the distal end of the shank portion including a threaded portion, the shank portion of the cutter bit being received in the base portion opening at a fixed position relative to the base portion;

wherein the opening of the base portion is internally threaded and engages the threaded portion of the shank portion of the cutter bit, and the base portion includes a lower region that has a second threaded portion of smaller diameter than the threaded portion engaging the shank portion of the cutter bit;

wherein a retainer is internally threaded into the opening of the base portion and threadably engaged in the second threaded portion; and wherein the cutter bit working end comprises a material selected from diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof.

2. The apparatus of claim 1, wherein the second threaded portion is threaded in an opposite direction from the threaded portion engaging the shank portion of the cutter bit.

3. The apparatus of claim 1, wherein the retainer includes at a lower end a working engagement surface that can be accessed through an opening in the base.

* * * * *